US009885103B2

(12) United States Patent
Cook et al.

(10) Patent No.: US 9,885,103 B2
(45) Date of Patent: Feb. 6, 2018

(54) ALLOY COATED WORKPIECES

(71) Applicant: KWIK-COAT (AUST) PTY LTD, Springvale, Victoria (AU)

(72) Inventors: Peter Charles Cook, Springvale (AU); Simon Nicholas Cook, Springvale (AU); Morris Taylor Murray, Briar Hill (AU)

(73) Assignee: KWIK-COAT (AUST) PTY LTD, Springvale, Victoria (AU)

( * ) Notice: Subject to any disclaimer, the term of this patent is extended or adjusted under 35 U.S.C. 154(b) by 10 days.

(21) Appl. No.: 14/425,134

(22) PCT Filed: Dec. 12, 2013

(86) PCT No.: PCT/AU2013/001453
§ 371 (c)(1),
(2) Date: Mar. 2, 2015

(87) PCT Pub. No.: WO2014/089624
PCT Pub. Date: Jun. 19, 2014

(65) Prior Publication Data

US 2015/0203951 A1 Jul. 23, 2015

(30) Foreign Application Priority Data

Dec. 12, 2012 (AU) ..... 2012905476

(51) Int. Cl.
*C23C 10/30* (2006.01)
*C23C 10/28* (2006.01)
(Continued)

(52) U.S. Cl.
CPC ..... *C23C 10/30* (2013.01); *C23C 10/28* (2013.01); *C23C 10/60* (2013.01); *C23C 24/045* (2013.01); *C23C 24/06* (2013.01); *C23F 17/00* (2013.01)

(58) Field of Classification Search
CPC ..... C23C 10/30; C23C 24/06
(Continued)

(56) References Cited

U.S. PATENT DOCUMENTS 1,815,638 A 7/1931 Watkins
3,013,892 A * 12/1961 Songas ..... C23C 24/045 241/184
(Continued)

FOREIGN PATENT DOCUMENTS

CN 1052512 A 6/1991
EP 0556065 8/1993
(Continued)

OTHER PUBLICATIONS

International Searching Authority, "Search Report", issued in connection with PCT patent application No. PCT/AU2013/001453, dated Feb. 24, 2014, 5 pages.
(Continued)

*Primary Examiner* — Alex A Rolland
(74) *Attorney, Agent, or Firm* — Hanley, Flight & Zimmerman, LLC

(57) ABSTRACT

A process for providing a corrosion resistant coating on uncoated ferrous components, involving mechanical plating, using as a coating medium a zinc metal-containing powder, such as zinc or zinc alloy powder, or a powder mixture of zinc or zinc alloy and at least one other metal, so as to build up a firmly adherent coating of the coating medium over exposed surfaces of the components, heating the components with the firmly adherent coating to produce solid-solid diffusion to form an Fe/Zn intermetallic over the surfaces, at least in a base layer of the coating built up by the plating, and cooling the components.

22 Claims, 4 Drawing Sheets

(51) Int. Cl.

| | |
|---|---|
| ***C23F 17/00*** | (2006.01) |
| ***C23C 24/04*** | (2006.01) |
| ***C23C 10/60*** | (2006.01) |
| ***C23C 24/06*** | (2006.01) |

(58) Field of Classification Search
USPC ..... 427/242
See application file for complete search history.

(56) References Cited

U.S. PATENT DOCUMENTS

| | | | | |
|---|---|---|---|---|
| 3,268,358 | A * | 8/1966 | Bothwell | C23C 10/00 148/535 |
| 3,442,691 | A * | 5/1969 | Pearson | C23C 24/045 118/418 |
| 3,583,290 | A * | 6/1971 | Briggs | F02B 77/02 92/158 |
| 3,808,031 | A | 4/1974 | Brill-Edwards | |
| 4,391,855 | A | 7/1983 | Geeck | |
| 4,628,004 | A | 12/1986 | Nickola et al. | |
| 5,354,579 | A * | 10/1994 | Watanabe | B22F 1/025 148/513 |
| 6,110,262 | A | 8/2000 | Kircher et al. | |
| 6,171,359 | B1 * | 1/2001 | Levinski | C23C 10/34 427/376.4 |
| 7,192,624 | B2 | 3/2007 | Shtikan et al. | |
| 7,241,350 | B2 | 7/2007 | Rosenthul | |
| 2003/0059542 | A1 | 3/2003 | Creech et al. | |
| 2005/0109433 | A1 | 5/2005 | Danger et al. | |
| 2006/0159858 | A1 | 7/2006 | Danger et al. | |
| 2006/0159859 | A1 | 7/2006 | Iwasawa | |
| 2009/0266454 | A1 | 10/2009 | Graf et al. | |
| 2010/0215980 | A1 | 8/2010 | Sheinkman et al. | |
| 2012/0006450 | A1 * | 1/2012 | Graf | C23C 10/02 148/527 |

FOREIGN PATENT DOCUMENTS

| | | |
|---|---|---|
| EP | 1365183 | 11/2003 |
| EP | 2218529 | 8/2010 |
| GB | 1041620 | 9/1966 |
| GB | 1071624 | 6/1967 |
| WO | 2014089624 | 6/2014 |

OTHER PUBLICATIONS

Demyashev et al., "Effect of Sn-alloying on Corrosion Resistance of Sherardised High Carbon Steel", Apr. 2011, 6 Pages.

Goodwing et al., "Engineering Properties of Zinc Alloys",Third edition, Published by International Lead Zinc Research Organization, Inc, Jan. 1989, 3 pages.

R.W. Bruner, "The Metallurgy of Die Casting", Society of Die Casting, Inc., 1986, 3 pages.

Arnold Satow, "Mechanical Plating", ASM Handbook, vol. 5; Surface Engineering, C.M. Cotell, J.A. S prague and F.A. Smidt, Jr., editors, p. 330-332, 1998, 3 pages.

American Galvanizers Association, "Zinc Coatings", 2006, 11 pages.

Mita et al., "Phase Diagram Study of Fe—Zn Intermetallics", Dec. 11, 2000, 4 pages.

European Patent Office, "Supplemental Search Report" issued in connection with European patent application No. 13863620, dated Apr. 19, 2016, 2 pages.

* cited by examiner

ALLOY COATED WORKPIECES

TECHNICAL FIELD

This invention relates to a method for providing alloy-coated work-pieces or components. The invention principally is concerned with producing ferrous products that are protected against corrosion by a coating, in particular a zinc-containing coating provided by use of a powder of zinc or of a zinc based powder comprising an elemental mix or zinc alloy.

BACKGROUND OF INVENTION

There is a wide variety of coating methods used to impart an acceptable level of corrosion resistance to ferrous components. The methods used can vary with the nature of the ferrous components, the composition of the coating and the nature of the service life to which the protected components are subjected. Ongoing research over many decades continues in the pursuit of better and more economic systems and in order to achieve corrosion resistance able to meet increasingly more stringent requirements. Corrosion resistance, measured in hours of corrosion-free operating life for ferrous components, is required to increase progressively, as levels of corrosion resistance acceptable in earlier eras no longer are satisfactory.

There are several different processes for applying zinc-containing coatings to impart corrosion resistance to ferrous components. Over many decades, zinc and zinc alloys have been applied by processes such as electroplating and hot-dipping. In the case of hot-dipping, aluminium containing zinc alloys have been found in recent decades to achieve a major improvement in the level of corrosion resistance able to be obtained. This initially was with zinc alloys with low levels of aluminium, such as Zn-(3-7%) Al. However more favourable corrosion resistance has been found to be possible with high aluminium containing alloys, such as with Zn-55% Al. Even more complex hot-dipping alloys have evolved, such as those with minor levels of Cu, Mg and Si, and attainment of favourable microstructures.

Zinc coatings applied by hot dipping and, to a lesser extent by electroplating, have achieved notable success in protecting ferrous components and products. They enable good protection against white zinc corrosion products, as well as against red rust corrosion resulting from corrosion of the ferrous base. However, electroplating and hot dipping are capital intensive and suitable for large ferrous products and for elongate ferrous material such as sheet, strip and wire.

Another process enabling formation of zinc or zinc alloy coatings, for protecting ferrous components against corrosion, utilises zinc or zinc alloy powder or flake dispersed in a liquid. The powder dispersion can be applied to ferrous components by dipping, brushing or spraying, or in any other suitable manner. The component then is heated to a temperature at which the liquid is vapourized, decomposed or cured to provide a zinc or zinc-containing coating. In some instances, the process is conducted to form a hard, wear resistance coating on the component. In other instances, the heating is at a temperature and for a period of time such that the iron of the substrate diffuses into the coating. Examples of this type of process, for a variety of metal powders and component types, are provided in the following patent references:

GB 1,071,624 to Imperial Smelting Corp (NSC) Ltd,
U.S. Pat. No. 1,815,638 to Watkins, U.S. Pat. No. 4,391,855 to Geeck,
U.S. Pat. No. 4,628,004 to Nickola et al,
U.S. Pat. No. 6,110,262 to Kircher et al,
US 2003/0059542 by Creech et al, and
US 2012/0006450 by Graf et al.

Zinc coatings also can be applied to ferrous components by a process widely known as Sherardising, invented in about 1900. Named after its inventor, Sheradising involves the burying of ferrous components in a bed of inert particulate filler, such as silica or alumina, in which a small quantity of zinc-containing powder is dispersed. The bed also may contain a material, such as clay. A housing containing the bed and buried components then is heated for several hours while the housing is rotated. The heating is to a temperature at which zinc is able to diffuse in a vapour phase to form a diffusion coating on the components by reaction with iron from the component surfaces. In the process, oxygen needs to be excluded to prevent the zinc from being oxidised.

Modern examples of Sheradising are disclosed in the following patents documents:

U.S. Pat. No. 3,808,031 to Brill-Edwards,
U.S. Pat. No. 6,171,359 to Levinski et al,
U.S. Pat. No. 7,192,624 to Shtikan et al,
U.S. Pat. No. 7,241,350 to Rosenthul,
US 2005/0109433 by Danger et al,
US 2009/0266454 by Graf et al, and
US 2010/0215980 by Sheinkman et al.

A development of Sherardising, attributed to the first-named inventor for U.S. Pat. No. 7,192,624, has been successfully commercialised under the trade mark ArmorGalv. The advance provided by the AmorGalv process is understood to reside in a "special zinc powder formulation". The process, described as thermal diffusion galvanising, is said to be an improved version of the well-established Sherardising zinc/iron vapour diffusion process. Successful corrosion protection in salt spray tests for greater than 1,000 hours is said to be common. As with the Sherardising process in general, the ArmorGalv process involves tumbling components in a housing within a furnace while heating at a temperature of from 315 to 450° C. The heating at such temperature is continued for 3 to 4 hours, after the components are cooled slowly over a similar period of time.

An alternative to sherardising is disclosed in the patent document:

US 2006/0159859 by Danger et al.

In the latter document, a profiled structure of steel sheet is fogged in metal powder in a chamber, the powder is electrostatically deposited over the sheet, the sheet is heat treated to form a coating by a diffusion process, and the sheet then is cooled. What "fogged" or "fogging" entails is not explained, but these terms seem to be intended to denote exposure to a smoke-like atmosphere of zinc dust.

Yet another process suitable for providing a protective coating is that referred to as mechanical plating, but also known as peen plating or cold welding. Mechanical plating is effective for applying zinc, tin or other ductile metal to components. A batch of components is charged to a barrel, with glass beads and fine powder or dust of the ductile metal to form a coating on the components. With rotation of the barrel, impacting and hammering energy is imparted to the components by the glass beads, with the powder or dust particles caused to cold weld to the surfaces of the components. Without risk of hydrogen embrittlement of the components or use of heat, the process results in a strongly adherent coating that is slightly porous, with a matte finish, and that provides corrosion protection to the coated components. The process is suitable for protecting a wide variety of relatively small components, and is widely used to provide corrosion protection for fasteners, such as bolts and self-tapping screws, including high-strength fasteners used in automotive body construction, particularly those having a hardness level above about 40 on the Rockwell C scale.

As recorded in ASM Handbook Volume 5, Surface Engineering (ASM International), published 1994, mechanical plating provides a straightforward method for achieving desired mechanical and galvanic properties, with an extremely low risk of hydrogen embrittlement and is accomplished at room temperature. The coating can be a single layer, or of at least two layers, depending for example on the environment in which corrosion protection is to be obtained, and whether another property such as low friction is to be attained.

The art is further extended by a paper entitled "Effect of Sn-alloying on Corrosion Resistance of Sherardised High Carbon Steel", by Demyashev et al, published in April, 2011 by Industrial Research Institute Swinburne (IRIS), an arm of Swinburne University. The IRIS paper deals with attempted improvement in the corrosion resistance of a steel surface conventionally Sherardised with zinc that is said to be appropriate for automotive industry application. Modification of conventional Sherardising with zinc is reported to have been achieved by:

(1) use of conventional Sherardising, but using a mixture of powder of Zn-10% Sn, or (2) mechanical plating, using Zn-10% Sn as an intermediate stage for further heat treatment, that is, as a stage which follows a Sherardising stage but precedes a heating stage.

With modification (1), corrosion resistance without red rust was up to 174 hours, compared to 42 hours for conventional Sherardising (using zinc without tin).

Modification (2) showed a further improvement, of up to 290 hours without red rust and 99 hours without white rust.

The present invention is directed to providing an alternative process for forming a protective coating on ferrous components to improve corrosion resistance.

SUMMARY OF THE INVENTION

According to the present invention, there is provided a process for coating ferrous components, wherein uncoated ferrous components are subjected to the steps of:

(a) mechanical plating, using as a coating medium a zinc metal-containing powder, such as zinc or zinc alloy powder, or a powder mixture of zinc or zinc alloy and at least one other metal, so as to build up a firmly adherent coating of the coating medium over exposed surfaces of the components, (b) heating the components with the firmly adherent coating so as to produce solid-solid diffusion to form an Fe/Zn intermetallic over the surfaces, at least in a base layer of the coating built up by the plating, and (c) cooling the components.

As indicated, the process is applied to uncoated ferrous components. That is, the exposed surfaces of the components, on which the coating is to be produced by mechanical plating, are to be bare metal surfaces, necessary to enable the required diffusion forming an Fe/Zn intermetallic layer. Thus, the components are to be free of any film or layer, such as formed by a treatment to provide corrosion resistance or by phosphating, painting or the like, applied prior to them being subjected to mechanical plating in accordance with the present invention. In contrast to the second modification proposed in the IRIS paper, the components are not Sherardised prior to being subjected to mechanical plating. However, the mechanical plating preferably is preceded by a treatment suitable for the purpose of ensuring that the exposed surfaces are clean and conditioned surfaces of the ferrous metal of the components, as explained in the general procedure set out below.

In the general procedure usually followed, the components typically will have been treated according to standard mechanical plating procedures recommended for use with formulations, such as those available under the registered trade mark ALZIN. Thus, the components may be treated with a hot alkaline cleaner, followed by an acid pickle and rinsing. Components free of oil are charged to a plating housing, usually an inclined barrel open at its upper end, such as of hexagonal or octagonal cross-section. The components can be cleaned in the housing, if required, using a proprietary descaler/degreaser. However some components can be in a condition enabling mechanical plating without clean, with reliance on starter formulations for cleaning. The components and impact media are loaded into the housing in about equal volumes, or with a greater volume of the media for heavier components or where a thicker coating is to be formed. The media of preference comprises glass beads of mixed sizes, ranging from about 4 mesh size up to about 60 mesh. A liquid, most usually water is added to the housing in a quantity such that the liquid level is from about 20 to 50 mm ahead of the contents of the housing as it is rotated during plating.

The contents of the housing in the general procedure may be at a temperature of about 20 to 30° C., although plating outside that range is possible. The rate of plating increases with temperature, to an extent that moderate heating may be needed for start-up at lower temperatures. Apart from this, heating is not required, while it is conceivable that mild cooling could be beneficial under extremely hot conditions, particularly as the temperature of the contents of the housing usually rises during plating.

At the outset of the general procedure, a starter formulation is added to the housing to ensure the correct conditions for plating. The starters can be used with separate acid sources. Initial rotation of the housing, such as for a couple of minutes, distributes the starter throughout the contents of the housing. Then a coppering and/or a tinning formulation may be added to the housing and, in combination with the starter, provides a base on the components facilitating controlled plating. The coppering and/or tinning action requires several minutes, after which a promoter formulation is added to the housing to promote ongoing plating of the components. To this stage, the zinc metal-containing medium has not been added to the housing, A small quantity of that zinc medium is added to form a "flash" coating which gives a good base for further plating. All of the zinc medium then is added and, while this can be by a single addition, better plating results from successive additions of several small quantities. During plating, the pH is monitored to ensure plating is not stopped by the pH rising above 2.0. Also, the coating thickness is monitored and, when the required thickness is achieved, remaining powder is removed to enable consolidation of the coatings formed. Thereafter, the components are rinsed and separated from the plating liquid, and coated with a chromate finish and with a sealant which substantially increases the duration of corrosion protection imparted to the components.

As pointed out in the IRIS paper, mechanically plated coatings can be porous, although the porosity level of 30 to 35% that is quoted is extreme for a high quality, industrially applied coating. In any event, porosity may well be a major factor in conventional mechanical plating being considered as suitable only for achieving a good and useful, but relatively low, level of corrosion protection for ferrous components. Thus, the IRIS paper proposes mechanical plating as a possible way in which to improve corrosion protection already provided by a prior step of Sherardising, with it widely recognised that Sherardising alone provides a higher level of corrosion protection than achieved by conventional mechanical plating. In this regard, a distinction is drawn between, on the one hand, conventional mechanical plating, which does not proceed beyond the first step of the process of the present invention and, as with the present invention, is applied to uncoated ferrous components and, on the other hand, mechanical plating which, as in the proposal of the IRIS paper, is applied to components that previously have been provided with a protective coating by Sherardising. In that proposal, the mechanical plating is not conventional for the reasons that (a) it is applied to a coated component as a consequence of the preceding Sherardising and (b) it is followed by a stage in which the component is heated for a second time (there of course being the heating for a first time inherent in the Sherardising process). The present invention utilises heating after the step of mechanical plating, but the plating applied to bare surfaces of components initially without a coating.

The present invention is believed to provide the first proposal that utilises a step of heating after conventional mechanical plating of the components. As indicated, conventional mechanical plating provides a porous coating that provides a lower level of corrosion protection in comparison with some other coating methods. However, it surprisingly is found that with a heat treatment step following mechanical plating of components that, prior to that plating were uncoated, enables the attainment of a level of corrosion protection that is significantly improved over the mechanical plating without the heat treatment.

The improved performance in corrosion resistance attained by the process of the invention is attributed to the nature of the Fe/Zn intermetallic produced by the solid-solid diffusion. The Fe/Zn intermetallic enables better corrosion resistance despite the porosity of the coating produced by mechanical plating being. The intermetallic resulting from solid-solid diffusion is found to be substantially pore-free. This evidently is due to the solid-solid diffusion proceeding from each of relatively densely packed points of solid-solid, metal-to-metal contact between individual powder particles and the surface of the ferrous component, with the diffusion from each point proceeding on a front that expands both inwardly and across the component surface so the fronts overlap and produce a substantially pore-free intermetallic surface zone.

The process of the present invention provides a level of improvement such that the corrosion resistance attained is at least comparable, and in many instances superior, to that attained by Sherardising, while it also can be at least comparable to the levels of corrosion resistance provided by the modifications suggested by the IRIS paper. This has significant benefits in that the process of the invention not only provides a more simple corrosion protection process but also one which avoids the substantial time and costs involved in a preceding stage of coating, such as by Sherardising. The IRIS paper understates the cost of Sherardising as being only 50% of the cost of Zn-electroplating. The cost of Sherardising itself is substantial. Also, Sherardising is a relatively slow process due to a slower rate of vapor to solid diffusion. Also, Sherardising is wasteful in its utilisation of zinc and it, of course, necessitates a substantial capital expenditure and operating costs both of which, for many forms of components, can be obviated by the process of the present invention.

In the process of the present invention, the zinc metal-containing powder may simply comprise zinc powder, and this is found to provide excellent corrosion protection by application in accordance with the invention. While other powders can provide comparable corrosion protection, some powder mixtures of zinc and at least one other metal, and some zinc alloys, are able to provide a higher level of corrosion protection, at least as determined by salt spray testing in accordance with ASTM B117. Powder mixtures of zinc with up to about 25 wt % tin, such as from about 6 to 20 wt % tin can be particularly beneficial in further improving corrosion protection, while zinc alloys with tin up to the same levels behave similarly. The zinc metal-containing powder may have a particle size that can vary as for conventionally used mechanical plating. The powder size may be from 2 to 30 μm, preferably from 3 to 8 μm In addition to zinc powder, a blend of zinc and tin powders, and zinc/tin alloys, other metals can be present. Thus, each of those options can include up to about 15 wt % aluminium, up to 6 wt % magnesium, and a combination of aluminium and magnesium up to those respective limits. Silicon at no more than 0.8 wt % can be present in an alloy powder, but silicon preferable is not used in a powder blend. Also, with a powder blend or alloy, copper can be present at up to about 0.8 wt % while, in each case, manganese can be present, but at a level not exceeding 0.1 wt %

The zinc powder, zinc powder blend or zinc alloy powder most preferably is free of hard metals that are incompatible with mechanical plating. Such hard metals include nickel, titanium, tungsten and molybdenum. Several other metals can be present but, in general, do not provide an improvement over the powders detailed as able to be used. Other metals preferably are present at a level not exceeding 0.5 wt % each, and not exceeding about 2.5 wt % in aggregate.

In conducting step (a) of the process of the invention, uncoated ferrous components are charged to an open ended and inclined, rotatable housing, along with glass beads providing an impacting medium and a sufficient quantity of the required zinc metal-containing powder. Unlike Sherardising processes such as ArmorGalv, the zinc metal-containing powder is not in a mixture with inert particulate material and, unlike processes using powder dispersed in a liquid to be painted on components, it does not contain a binder. The powder preferably contains aids usual in mechanical plating, such as detailed above. The housing may be of a form usually employed for mechanical plating. Also, the mechanical plating does not require heating. Rather the mechanical plating is conducted without heating and under ambient conditions. Those conditions include operation in the prevailing ambient atmosphere. Unlike Sherardising, it is not necessary to operate in an atmosphere that has an appropriately low oxygen content, such as not more than about 100 ppm, in order to meet the Sherardising requirement for avoidance of oxide contamination of the coating as otherwise would result during heating.

The mechanical plating of step (a) of the present invention is continued for a period of time appropriate to achieve the required coating thickness. The coating thickness can range from about 2 to 150 μm, such as from 10 to 75 μm. For usual coating thicknesses a period of time for the mechanical plating can range from 0.5 hours, but preferably does not exceed 2.5 hours. This period is determined solely by the required coating thickness as temperature is not a relevant parameter. With Sherardising temperature is an important parameter, and quoted figures range widely, such as from 200 to 500° C., but more usually from 300 to 450° C., with published data on the ArmorGalv process indicating 315 to 450° C. (expressed as 600 to 850° F.), for a time period of from 3 to 4 hours (with an implicit inverse relationship between time and temperature). Not only is the mechanical plating step of the invention conducted with temperature effectively a constant, the duration of the step typically is relatively short and can ranges from about 0.5 to 4 hours, preferably from 0.5 to 3.5 hours, such as from 1.5 to 2.5 hours. The generally shorter time for laying down the coating by the mechanical plating step is attributable to the coating being formed by impacting and hammering energy imparted by the glass beads, rather than by reliance on the relatively slower mechanism of thermal diffusion galvanising on which Sherardising is based.

In conducting step (b) of the invention, the coated components are heated in a housing that either is open to the atmosphere or maintains an atmosphere having a low oxygen content, such as below about 100 ppm, at a positive over-pressure. The heating is to a temperature at which solid-solid diffusion producing Fe/Zn intermetallic is produced. The temperature may be from 315 to 415° C., but preferably is from 360 to 380° C. Dependent on the temperature, the duration of heating may be for from about 0.4 to 3 hours, preferably from 1.5 to 2.5 hours. On completion of the heating step the coated components are cooled, either in the atmosphere in which they were heated in step (b) or in an ambient atmosphere. Forced cooling, such as water quenching, can be used, although it is sufficient and acceptable for the components to be allowed to cool naturally, such as by air-cooling.

After heating in step (b) of the invention the coating exhibits cracks, like coatings produced by Sherardising. However, unlike Sherardised coatings, the coatings as produced in step (a) exhibit porosity. The components after step (a) of the invention, as with mechanically plated components in general, exhibit a good, useful level of corrosion resistance for many applications, although the level is below the achievable by the Sherardising process. Despite this, it surprisingly is found that after proceeding beyond step (a), to complete steps (b) and (c) of the invention, the corrosion resistance imparted to the components by the resultant coating resulting from the solid-solid diffusion is raised to a higher level, making the components suitable for a much wider range of applications. Thus, while the coating produced by the overall process of the invention can still exhibit some apparent porosity, this does not detract from the significant and substantial increase in the level of corrosion resistance achieved over the level of corrosion resistance achieved from conventional mechanical plating alone. The level of improvement is such that corrosion protection at least comparable to that obtained by Sherardising can be achieved by use of the present invention.

Data on Sherardising, specifically in ArmorGalv, is published in "DELNORTH Introduces: ArmorGalv® (see: www.armorgalv.com.au/SiteFiles/armorgalvcomau/DELNORTH_ARMORGALV_PRESENTATION.pdf).

A table at page 12 of the Delnorth paper categorises the corrosion resistance of the coating formed by mechanical plating as "Moderate", in line with the performance of hot dipping and dip/spin and compared to "Moderate to Good for Alloys" for electroplating and "Excellent" for ArmorGalv Thermal Diffusion. Page 6 of that Delnorth paper refers to tests still underway as at Jul. 1, 2009, confirming it provides a relatively contemporary data. Also, at page 7, salt spray results of greater than 1,000 hours are indicated as common with ArmorGalv. At page 6, there is reference to an ArmorGalv Bronze coating of 25 μm achieving a salt spray test duration of 4,000 hours and an ArmorGalv Natural coating of 40 μm achieving a salt spray test duration of 5,000 hours. Depending on thickness, the coatings provided by the present invention are able to exceed 1,000 hours, and can achieve levels close to or above 4,000 hours, in salt spray testing, at least when, as with the ArmorGalv coatings, the plated components are provided with finishing coatings, such as detailed above with reference to chromate and sealant finishes.

The solid-solid diffusion in step (b) of the invention is achieved under conditions that are significantly different to those obtaining in Sherardising. In Step (a) of the process of the invention, the coating formed by mechanical plating is built up by individual particles of the zinc metal-containing powder being cold welded as flattened micro-platelets on the surfaces of the components and on previously cold welded platelets. A progressive build-up of platelets results from the impacting and hammering action of the glass beads and occurs without solid-solid diffusion. The solid-solid diffusion during step (b) occurs in the present invention in the completely formed coating resulting from step (a). As a consequence, diffusion of iron from the components is able to progress through the coating, from the interface between surfaces of the components and their coatings. In contrast, the coating achieved by Sherardising processes such as ArmorGalv are described as involving zinc vapour that contacts the components so that zinc initially condensing on the surfaces of the components forms Fe/Zn intermetallic. With continuing condensation of zinc, iron is able to diffuse from the surfaces of the components and through the intermetallic coating being built up, with condensing zinc also able to diffuse through the forming intermetallic coating through to the component surfaces.

Particularly with a coating-medium comprising pure zinc, the coating produced by step (a) of the invention can exhibit porosity. With a coating medium comprising a mixture of zinc and tin powders or zinc-tin alloy, the coating produced by step (a) can be free of pores, with increasing levels of tin favouring a pore free coating. Where porosity tends to occur, the level of porosity can decrease with the period of time over which step (a) is conducted, due to an increasingly thicker coating being formed and a resultant increase in the percentage of the surface area of the components over which platelets are cold welded in forming the coating. However, increasing coating thickness tends not to avoid some residual porosity usually remains after step (a). However, salt spray test results achieved with components coated in accordance with the present invention indicate that the effect of the porosity is ameliorated, if not fully offset, by the solid-solid diffusion achieved in step (b) of the invention.

The reasons for the improved corrosion resistance achieved by the invention over conventional mechanical plating are not fully understood at this stage. Indications are that the improvement results from the different conditions under which solid-solid diffusion occurs in step (b), compared with the conditions applying in Sherardising. At least to a degree, it seems that solid-solid diffusion in step (b) may result in a reduction in the size of pores where the coating resulting from step (a) is porous, while there also may be migration of zinc during step (b), from the coating, to the surface of components exposed by the pores. However, at least under some conditions, components treated by the process of the invention can exhibit minor red rust spots after an early stage of salt spray testing but, although this does not deteriorate during further protracted testing and the end result is that the components exhibit excellent long-term corrosion resistance. The minor rust spots are not such, for example, as to make difficult the unthreading of a nut and bolt assembly protected by coatings formed in accordance with the invention. The minor rust spots do not indicate base metal corrosion, that is, corrosion of the component below the coating, but rather colouring from oxidation of iron drawn from surface intermetallic.

DETAILED DESCRIPTION OF THE INVENTION

A number of batches of components were provided with corrosion protection coatings by the process of the invention. In each case, step (a) of the process was conducted by using a standard mechanical plating procedure utilising an aqueous solution with the addition of inhibited acid for cleaning and pH control and a cleaning process to remove all oxides and produce a surface suitable for further processing. The processing steps after cleaning comprised:

(1) Copper immersion coating;
(2) Tin immersion coating;
(3 Addition of plating promoter and zinc "flash";
(4) Metal powder additions at regular intervals to achieve desired thickness;
(5) Flush out solution at completion of plating cycle, with additional rinses; and
(6) Separation of parts from impact media.

Example 1—Zinc Coating

A quantity of components comprising 1.3 Kg of 12×50 Hexagon head T17 steel roofing screws was processed in 2 liters of impact media (40% 5 mm, 40% 3 mm and 20% 0.7 mm) using the above standard procedure. 90 grams of zinc powder with a nominal particle size 4.5 μm was used to achieve a desired plating thickness. The zinc powder was added in 6×15 gram increments at intervals of 3 minutes. A period of 10 to 12 minutes was allowed after last addition of zinc for plating completion and polishing. The components then were rinsed and separated without any additional treatments. The coating thickness achieved was approximately 55 μm.

Example 2—Zinc/Tin Coating

A quantity of components comprising 1.2 Kg of 12×50 Hexagon head T17 steel roofing screws and 200 grams of 5 mm×10 mm long flat head semi tubular steel rivets were processed in 2 liters of impact media (40% 5 mm, 40% 3 mm & 20% 0.7 mm) using the above standard procedure. 60 grams of blended zinc and tin powders were used to achieve desired plating thickness. The zinc powder had a nominal particle size 4.5 μm while the tin powder grade was −325 mesh. The composition of the blended powder was Zn-80% and Sn-20%. The blended powder was added in 6×10 gram increments at intervals of 3 minutes. About 10-12 minutes was allowed after last addition of powder for plating completion and polishing. The components then were rinsed and separated with no additional treatment. The coating thickness achieved was approximately 35 μm.

Example 3—Temperature

Figure 1:
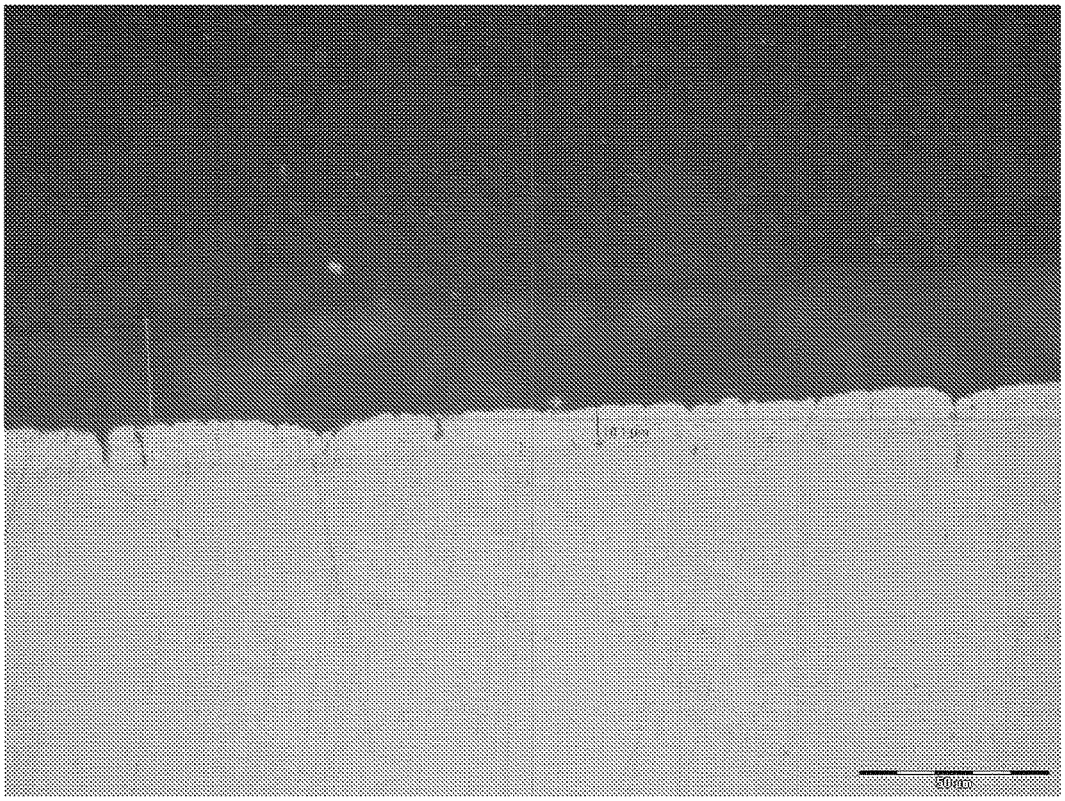
FIG. 1 is a photomicrograph of an example zinc coated component prepared in accordance with teachings disclosed herein.

Ten samples of zinc coated components produced by Example 1 were placed in a 1 m diameter fan-forced oven that was preheated to a temperature of 320° C. The components were supported in a steel mesh cage. The parts were held for 120 minutes and then removed with the cage and allowed to cool in air. The screws were cross-sectioned, polished to 1 μm abrasive and etched in a mild caustic solution. There was a clear intermetallic layer formed, as illustrated in FIG. 1 of the accompanying drawings.

Example 4—Time Comparison

Figure 2:
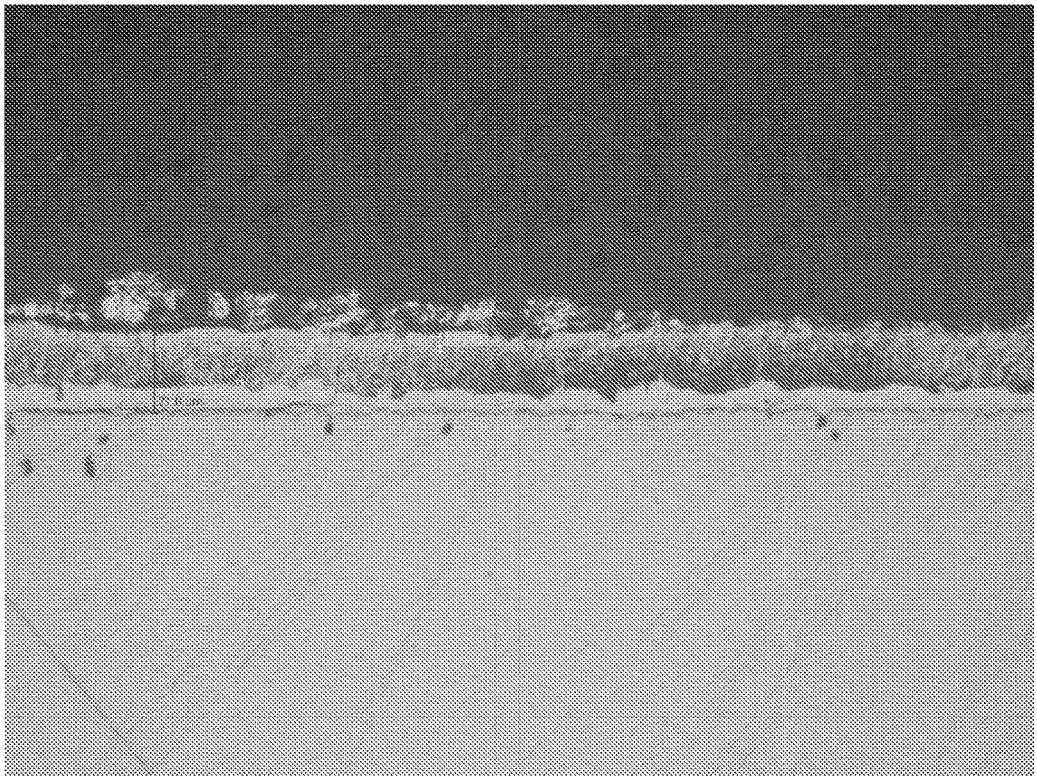
FIG. 2 is a photomicrograph of an example zinc coated component prepared in accordance with teachings disclosed herein.

Example 3 was repeated, with ten other zinc coated components produced by Example 1, except that the oven temperature was 380° C. and the components were held at that temperature for 30 minutes. Again the screws were cross-sectioned, polished to 1 μm abrasive and etched in mild caustic solution. There was a clear intermetallic layer formed, as seen in FIG. 2.

Example 5—Atmosphere

Ten samples of zinc-coated screw components produced by Example 1 were placed in a glass tube that then was flushed with argon. The glass tube was closed at one end and, after insertion of the components, the other end was closed, sealing the screws in an argon atmosphere. The glass-encased screws were placed in a wire mesh basket and placed in a 1 m diameter fan-forced oven that was preheated to a temperature of 380 C. The parts were held for 120 minutes and then removed with the cage and allowed to cool in air. The glass capsules were then broken and the screws released.

Figure 3:
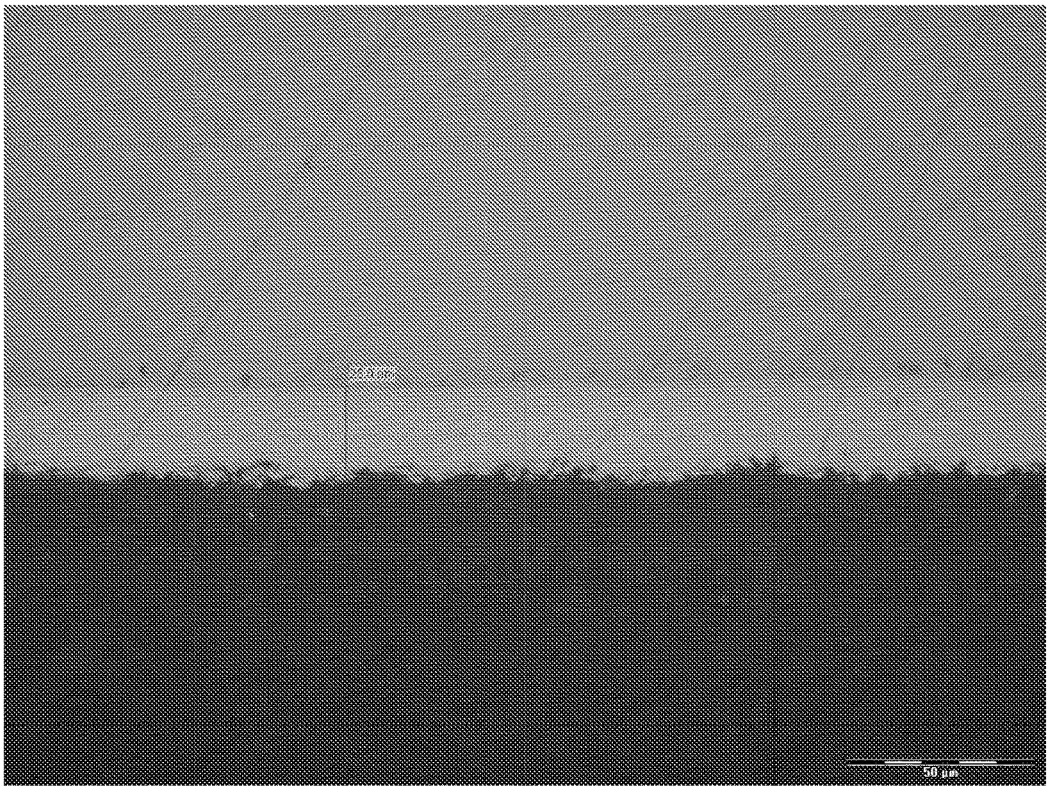
FIG. 3 is a photomicrograph of an example zinc coated component prepared in accordance with teachings disclosed herein.

The screws were cross-sectioned, polished to 1 μm abrasive and etched in a mild caustic solution. There was a clear intermetallic layer formed, as shown in FIG. 3.

Example 6—Alloy

Figure 4:
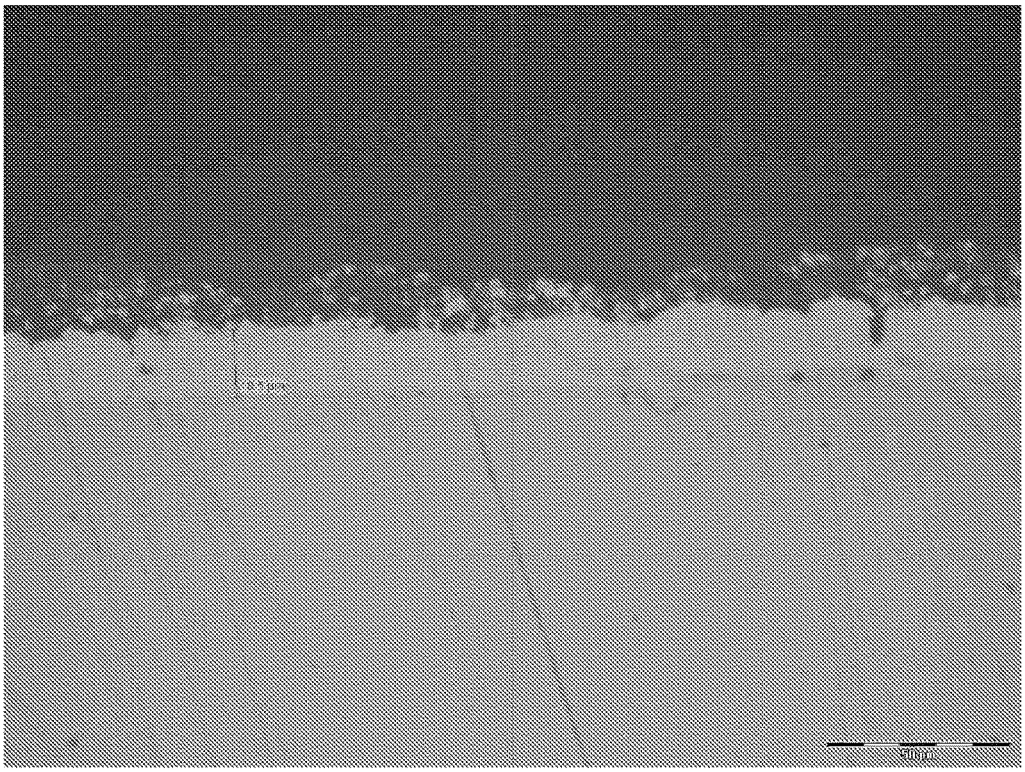
FIG. 4 is a photomicrograph of an example zinc coated component prepared in accordance with teachings disclosed herein.

Ten Zn/Sn coated screw components from Example 2, all comprising screws, were placed in a 1 m diameter fan-forced oven that was preheated to a temperature of 380 C. The screws were supported in a steel mesh cage. The parts were held for 120 minutes and then removed with the cage and quenched into water. The screws were cross-sectioned, polished to 1 μm abrasive and etched in mild caustic solution. There was a clear intermetallic layer formed, as seen in FIG. 4.

Extensive standard salt spray testing already has been conducted on components produced in the manner detailed in the preceding Examples, and such testing is continuing. To date the testing has established that the process of the present invention provides excellent corrosion protection for ferrous components. The level of protection is superior to that obtained by mechanical plating alone, and at least comparable to the level of corrosion protection obtainable with Sherardising. The invention provides a level of corrosion that is well suited to a wide range of uses and environments for ferrous components.

What is claimed is:

1. A process for providing a corrosion resistant coating on ferrous components, the process comprising:

mechanical plating uncoated ferrous components using as a coating medium a zinc metal-containing powder, so as to build up a firmly adherent cold welded coating of the coating medium over exposed surfaces of the components, the mechanical plating conducted without heating, the mechanical plating including (i) charging the uncoated ferrous components into an inclined rotatable housing along with glass beads, a quantity of the coating medium, and an aqueous solution, and (ii) rotating the housing for a period of time to achieve a cold welded coating thickness by particles in the coating medium being cold welded to the components under a hammering action of the glass beads against the components, the coating medium corresponding to at least one of elemental metal powder or alloy metal powder, the coating medium substantially free of iron and containing:

from 6 to 25 wt % of tin, from 0 to 15 wt % of aluminium, from 0 to 6 wt % of magnesium, from 0 to 0.8 wt % of silicon, from 0 to 0.8 wt % of copper, from 0 to 0.1 wt % of manganese, not more than 0.5 wt % each and 2.5 wt % in aggregate of metals other than the zinc, the tin, the aluminium, the magnesium, the silicon, the copper, and the manganese, and a balance of the zinc;

heating the components with the firmly adherent cold welded coating so as to produce solid-solid diffusion, with diffusion of iron from the components to the cold welded coating, to form a substantially pore-free layer of an Fe/Zn intermetallic over the surfaces of the components in at least a base layer of the firmly adherent cold welded coating built up by the mechanical plating; and cooling the components.

2. The process of claim 1, wherein the exposed surfaces of the components, on which the cold welded coating is to be produced by the mechanical plating, are bare metal surfaces, to enable formation of the Fe/Zn intermetallic, with the components free of any film or layer prior to the mechanical plating.

3. The process of claim 1, wherein prior to the mechanical plating, the components are at least one of degreased or treated to remove surface rust.

4. The process of claim 1, wherein the components produced by the process have a level of corrosion protection that is significantly improved over the mechanical plating without the heating of the components.

5. The process of claim 4, wherein the level of corrosion protection is at least comparable to that attained by Sherardising.

6. The process of claim 1, wherein the cold welded coating thickness is 2 to 150 μm.

7. The process of claim 1, wherein the period of time for the mechanical plating is from about 0.5 to 4 hours.

8. The process of claim 1, wherein after the mechanical plating, the cold welded coated components are heated in the housing while the housing either is open to the atmosphere or maintains an atmosphere having a reduced oxygen content, below about 100 ppm, at a positive over-pressure.

9. The process of claim 1, wherein the heating to produce the solid-solid diffusion is conducted at a temperature ranging from 315 to 415° C.

10. The process of claim 1, wherein a duration of heating is from about 0.4 to 3 hours.

11. The process of claim 1, further including cooling the components either in an atmosphere in which the components were heated or in an ambient atmosphere.

12. The process of claim 11, wherein at least one of forced cooling is used to cool the components or the components are allowed to cool naturally.

13. The process of claim 12, wherein the forced cooling is implemented by a water-quench.

14. The process of claim 12, wherein the components are allowed to cool naturally by air-cooling.

15. The process of claim 1, wherein prior to the mechanical plating, the components are at least one of degreased, treated by acid pickling, or treated with an engineered abrasive.

16. The process of claim 1, wherein the zinc metal-containing powder is a powder mixture of zinc with about 6 to 20 wt % tin.

17. The process of claim 1, wherein the zinc metal-containing powder is a zinc alloy powder with about 6 to 20 wt % tin.

18. The process of claim 1, wherein the cold welded coating thickness is from about 10 to 75 μm.

19. The process of claim 1, wherein the period of time for the mechanical plating is from 0.5 to 3.5 hours.

20. The process of claim 1, wherein the period of time for the mechanical plating is from 1.5 to 2.5 hours.

21. The process of claim 1, wherein the heating to produce the solid-solid diffusion is conducted at a temperature ranging from 360 to 380° C.

22. The process of claim 1, wherein a duration of heating is from 1.5 to 2.5 hours.

* * * * *